US006758156B1

(12) United States Patent
Kobas

(10) Patent No.: US 6,758,156 B1
(45) Date of Patent: Jul. 6, 2004

(54) PONTOON BOAT FENDER

(75) Inventor: Joseph P. Kobas, Amsterdam, NY (US)

(73) Assignee: Taylor Made Products, Gloversville, NY (US)

( * ) Notice: Subject to any disclaimer, the term of this patent is extended or adjusted under 35 U.S.C. 154(b) by 0 days.

(21) Appl. No.: 10/627,870

(22) Filed: Jul. 28, 2003

(51) Int. Cl.[7] ..... B63B 59/02
(52) U.S. Cl. ..... 114/219
(58) Field of Search ..... 114/219

(56) References Cited

U.S. PATENT DOCUMENTS 4,664,053 A * 5/1987 Mesinger ..... 114/219
4,738,215 A * 4/1988 McMahon ..... 114/219
5,243,926 A 9/1993 Wright et al.
5,273,473 A 12/1993 Allen
D359,019 S 6/1995 Kimball
5,664,517 A 9/1997 Brydel et al.
5,671,692 A 9/1997 Kimball
6,021,729 A 2/2000 DeRuscio
6,082,931 A 7/2000 Hopper
6,364,293 B1 4/2002 Beckett
6,477,973 B1 11/2002 Kobas

* cited by examiner

*Primary Examiner*—Ed Swinehart
(74) *Attorney, Agent, or Firm*—Nixon & Vanderhye PC

(57) ABSTRACT

The fender shaped specifically for pontoon boats, so that it may be readily attached to the pontoon boat decking and/or suspended from the pontoon boat rail. The pontoon boat fender is uniquely shaped to abut the decking and engage the pontoon to protect the decking and pontoon from damaging contact with a dock or another boat.

18 Claims, 3 Drawing Sheets

PONTOON BOAT FENDER

BACKGROUND AND SUMMARY OF THE INVENTION

The invention provides a uniquely shaped fender that may be detachably secured to the side of a pontoon boat to protect the pontoon boat from damage to the rub-rail, decking, and/or pontoons.

Conventional pontoon boats include aluminum decking that runs around the perimeter of the boat and a pair of aluminum pontoons extending longitudinal along the starboard and port sides of the boat, below the deck.

It is an object of the invention to provide a watercraft fender that is readily attachable to the rub rail and/or deck of a watercraft buoyed by pontoons, to protect the watercraft from damage to the rub-rail, decking, and/or pontoons.

The fender provided in accordance with the invention is shaped specifically for pontoon boats, so that it may be readily attached to the pontoon boat decking and/or suspended from the pontoon boat rail. The pontoon boat fender of the invention is uniquely shaped to engage the decking and the pontoon to protect them from damaging contact with the dock or other boats.

The foregoing and other objects of the invention are thus achieved by providing a fender for a pontoon boat having a deck and at least one pontoon suspended below the deck and extending along at least one longitudinal side edge of the deck, the fender comprising: a deck engaging portion including a stop face for abutting a portion of the peripheral edge of the deck; a pontoon engaging portion including a concavely curved recess to receive and engage at least a portion of the pontoon; and a bumper portion to at least one of deflect and cushion impacts with adjacent structures.

The invention may also be embodied in a method for shielding and protecting a longitudinal side edge of a pontoon boat comprising: providing a pontoon boat including a deck having a peripheral edge, at least first and second pontoons mounted below said deck, said pontoons respectively extending along each longitudinal side edge of said deck; providing a fender having a stop face for abutting a portion of the peripheral side edge of said deck, a concavely curved recess for engaging at least a portion of a surface of a said pontoon, and a bumper portion to at least one of deflect and cushion impacts with adjacent structures; and disposing said fender so that said concavely curved recess engages at least a port ion of a surface of a said pontoon, and so that said deck engaging portion is disposed adjacent said peripheral edge of said deck.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
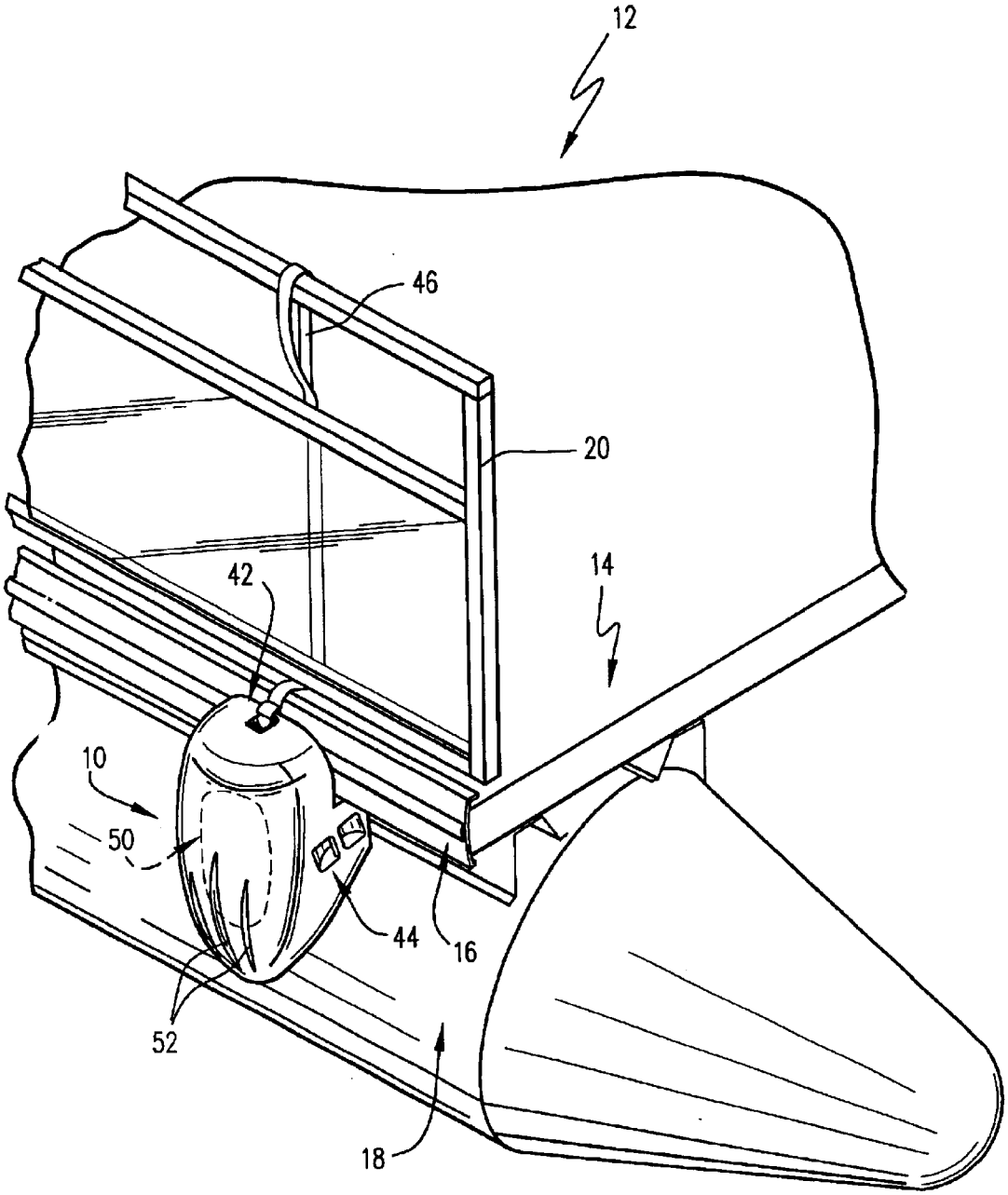
FIG. 1 is a perspective view of a fender embodying the invention secured to the side of a pontoon boat in accordance with an embodiment of the invention.
Figure 2:
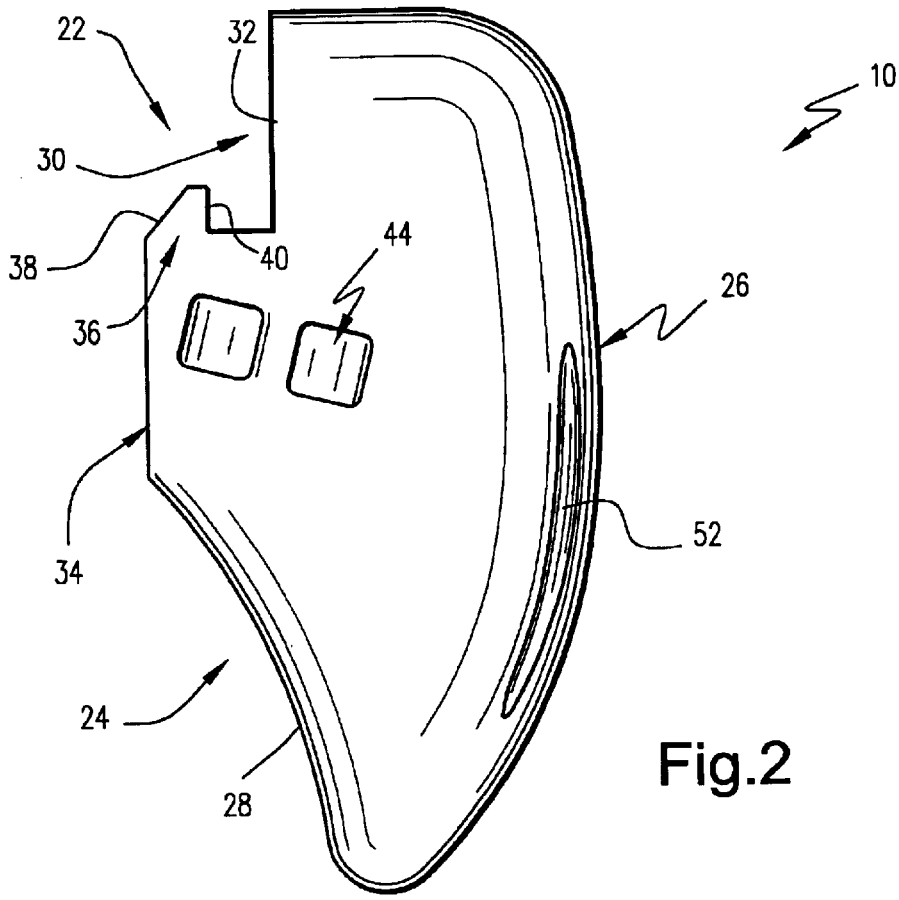
FIG. 2 is a side elevational view of a pontoon fender embodying the invention.

FIG. 1 illustrates a fender 10 provided in accordance with an embodiment of the present invention, attached to a conventional pontoon boat structure 12. As illustrated, conventional pontoon boats include aluminum decking 14 that runs around the perimeter of the boat, a rub-rail 16 provided as a cap to the side edge of the decking, and a pair of aluminum pontoons 18 (only one of which is shown in FIG. 1) extending longitudinal along the starboard and port sides of the boat, below the deck. The illustrated boat also includes a side railing, schematically shown at 20.

The watercraft fender 10 of the invention is adapted to engage the rub rail 16 and/or deck 14 of the watercraft and to engage the respective pontoon 18. Thus, the fender includes a first, deck engaging portion 22 configured and disposed to abut a portion of the rub rail and/or the side edge of the decking 14 and a second, pontoon, engaging portion 24 configured and disposed to engage a portion of the adjacent pontoon 18.

The watercraft fender of the invention is also adapted to deflect and/or cushion contact with adjacent objects such as a dock or another boat. Thus, the fender further includes a third, bumper portion 26 configured to deflect and/or cushion impacts against adjacent objects such as the dock or another boat.

To properly orient the fender with respect to the pontoon, the second, pontoon engaging portion 24 of the fender includes a concavely curved recess 28 having a curvature generally corresponding to that of the pontoon 18. It is to be appreciated that the concavely curved recess may have a radius of curvature that is generally the same as, or greater than, that of the pontoon so that, at least a portion of the concave recess 28 can engage the pontoon 18. It is preferred that the radius of curvature not be smaller than that of the associated pontoon so that there is at least some surface to surface contact between the surface of the concave recess and the pontoon.

In the illustrated embodiment, the pontoon 18 is spaced from the deck 14 and a rub rail 16 caps the side edge of the deck and depends vertically below the deck but is spaced from the pontoon. To engage the rub rail and deck in this assembly, the first portion 22 of the fender includes a cutout 30 to define a stop face for abutting the rub rail/deck and a buffer flange portion 34 extending generally perpendicular to the stop face for being disposed between the rub rail/deck and the pontoon. In an exemplary embodiment, to maintain the fender in position and to secure the fender to the boat, a hook 36 is defined adjacent the end edge of the buffer flange for engaging the downwardly depending rub rail 16 to resist lateral shifting and/or removal of the fender 10. In the illustrated embodiment, the hook includes an inclined surface 38 and a generally vertical face 40. Because the pontoon fender is formed from a flexible material, when the fender is moved towards the pontoon boat assembly, the inclined surface allows the hook to engage, be deflected by and resiliently re-form behind the rub rail to hook the pontoon fender in place with the buffer flange defining a buffer portion of the pontoon fender, between the rub rail/deck and the pontoon.

In addition, or in the alternative to a hook engagement as provided by the hook and buffer flange portion 34, the fender 10 may be secured to the pontoon boat with straps, ropes, or the like. Thus, to facilitate the attachment of the fender to the boat and to secure the fender in place, or to ensure that the fender will not be lost during transport, strap, rope or other fastener receptacles 42,44 may be defined at spaced locations about the fender. In the illustrated embodiment, a tether strap receptacle 42 is defined at the top front edge of the fender and fastener receptacles 44 are defined or provided on the right and left sides of the fender. As illustrated in FIG. 1, a tether strap 46 may be secured at one end to the tether strap receptacle 42 and at the other end to the side rail 20 or another fixture of the pontoon boat. Thus, if the fender is disengaged from the pontoon and rub rail, it will remain attached to the boat by the tether strap 46 and can be re-mounted or repositioned as necessary to shield the side edges of the boat.

As noted above, the third portion 26 of the fender, which defines the front face of the fender, is configured to deflect and/or cushion impacts between the pontoon boat and the dock or another vessel. To facilitate the deflection and cushioning effect, the front or bumper portion of the fender is preferably continuously convexly curved defining a gradual transition from a bottom most end where lesser bumper function is required to a more sizable bumper structure diametrically opposite the buffer flange portion and the stop face 32 of the first portion.

Figure 3:
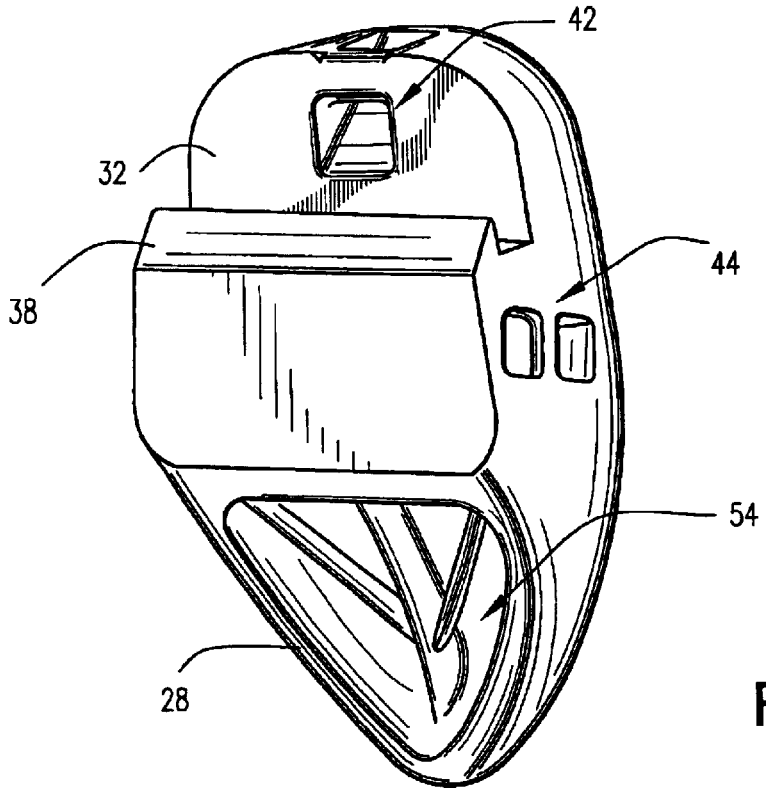
FIG. 3 is a perspective view from the rear and below of a pontoon fender embodying the invention.
Figure 4:
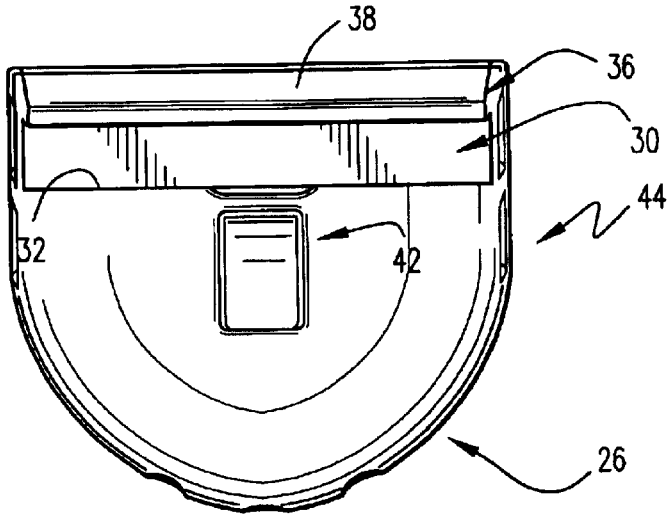
FIG. 4 is a top plan view of the pontoon of FIGS. 1–3.

As illustrated in FIG. 3, in particular, where the fender is molded in part or in its entirety, void(s) 54 may be defined in the pontoon engaging section 28 and/or in the stop face 32 (not shown) to facilitate the molding process, to save material and/or to adjust the resilience of the fender. In the illustrated embodiment there is ribbing on the concavity 54 to minimize any bulging caused by inflation pressure.

Figure 5:
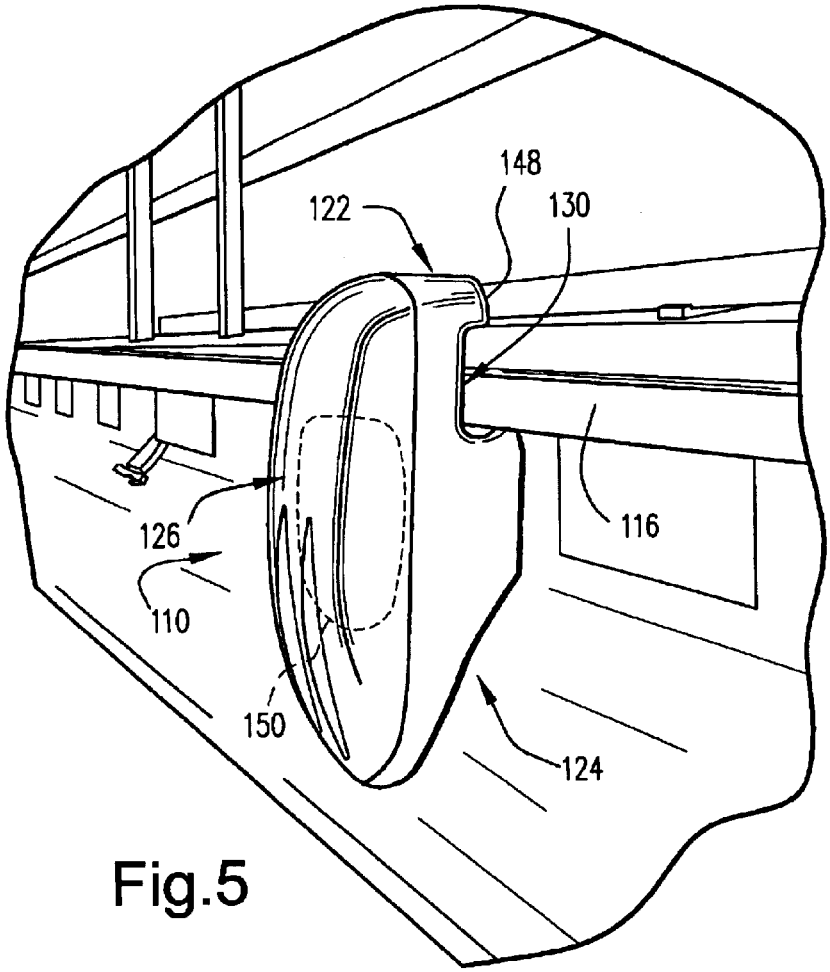
FIG. 5 is a perspective view of a pontoon fender provided in accordance with a second embodiment of the invention, secured to the side of a pontoon boat.

The embodiment of FIGS. 1–4 is adapted in particular to a pontoon boat having a rub rail 16 with a gap between the rub rail and the pontoon so that the buffer flange portion 34 and hook 36 may be engaged under the rub rail to hold the fender in position. In addition or in the alternative, a second securing flange 148 may be provided to project rearwardly at the top of the fender 110 as illustrated in FIG. 5, to define a generally C-shaped receptacle 130 for receiving the rub rail 116 while grasping the decking from above and below. It is to be understood that the hook and/or flanges may be modified in configuration to accommodate a variety of conventional rub rail and decking sizes and configurations without departing from this invention.

As illustrated in FIG. 5, the first and/or second portions 122,124 of the fender may be separately formed from the third portion 126 and then coupled or secured to one another during the manufacturing process. In this way materials having variant densities, resilience and/or wear resistance, for example, may be provided for the respective portions of the fender so as to be best suited to the respective functions of the respective portions.

Whether the pontoon fender is provided as an integral, one piece molded structure as shown in FIG. 1 or in two parts as shown in FIG. 5, the fender structure may include a gas chamber 50,150, e.g., in the third, bumper portion 26,126, which is fillable with a pressurized gas such as air. An inflation valve (not shown) may be provided to operatively communicate with the gas chamber. The gas chamber provides added cushioning and also serves to increase the fender useful life. In the illustrated embodiment, grooves 52 are defined on the face of bumper portion 26, e.g. for aesthetics. The fender may have a protective covering or coating and the covering or coating may be aesthetically colored or designed, abrasion resistant and/or waterproof.

By virtue of the structure and method according to the present invention, a fender is provided that is particularly suited for a pontoon boat and is readily attachable to the rub rail/deck and/or may be tethered to the side rail. The configuration of the fender to accommodate the pontoon, in particular including a concavely curved pontoon engaging recess, ensures that the fender will be properly disposed to effectively deflect or cushion pontoon level impacts with docks or other boats. Additionally and similarly, the provision of a deck/rub rail engaging portion ensures that the fender will be properly disposed to effectively deflect or cushion deck level impacts with docks or other boats.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fender for a pontoon boat having a deck and at least one pontoon suspended below the deck and extending along at least one longitudinal side edge of the deck, the fender comprising:

a deck engaging portion including a stop face for abutting a portion of the peripheral edge of the deck;

a pontoon engaging portion including a concavely curved recess to receive and engage at least a portion of the pontoon; and a bumper portion to at least one of deflect and cushion impacts with adjacent structures.

2. A fender as in claim 1, further comprising at least one securing member to attach said deck engaging portion to the boat.

3. A fender as in claim 2, wherein the at least one securing member comprises at least one flange extending generally perpendicular to said stop face.

4. A fender as in claim 3, wherein the at least one securing member comprises a first buffer flange portion disposed between said stop face and said pontoon engaging portion, and a second securing flange projecting from an upper edge of said stop face.

5. A fender as in claim 3, further including a hook defined adjacent a free end of said flange.

6. A fender as in claim 3, wherein said fender has a top end and a bottom end and said flange extends adjacent said top end of the fender for engaging a top surface of the deck.

7. A fender as in claim 2, wherein the at least one securing member comprises at least one receptacle for a strap or rope for securing the fender to the pontoon boat.

8. A fender as in claim 7, wherein one said receptacle is defined adjacent a top edge of said stop face.

9. A fender as in claim 7, wherein there are a plurality of said receptacles including receptacles defined adjacent side edges of said stop face.

10. A fender as in claim 1, wherein said fender includes a buffer portion for being disposed between and bridging said pontoon and a bottom of said deck.

11. A fender as in claim 1, further comprising a gas chamber defined within said bumper portion.

12. A fender as in claim 1, wherein said bumper portion and said deck engaging portion are separately formed.

13. A fender as in claim 1, wherein said deck engaging, pontoon engaging, and bumper portions are formed by molding.

14. A method for shielding and protecting a longitudinal side edge of a pontoon boat comprising:

providing a pontoon boat including a deck having a peripheral edge, at least first and second pontoons mounted below said deck, said pontoons respectively extending along each longitudinal side edge of said deck;

providing a fender having a stop face for abutting a portion of the peripheral side edge of said deck, a concavely curved recess for engaging at least a portion of a surface of a said pontoon, and a bumper portion to at least one of deflect and cushion impacts with adjacent structures; and disposing said fender so that said concavely curved recess engages at least a portion of a surface of a said pontoon, and so that said deck engaging portion is disposed adjacent said peripheral edge of said deck.

15. A method as in claim 14, further comprising securing said fender to said pontoon boat.

16. A method as in claim 15, wherein said securing comprises providing a fender including at least one flange extending generally perpendicular to said stop face and a hook defined adjacent a free end of said flange, and said securing comprises hooking said fender to said deck with said hook.

17. A method as in claim 16, wherein a rub rail is secured to the peripheral edge of said deck and said hooking comprises hooking said hook behind said rub rail.

18. A method as in claim 14, wherein said fender further comprises at least one receptacle for a strap or rope and said securing comprises securing the fender to the pontoon boat with at least one rope or strap.

* * * * *